US006736705B2

(12) United States Patent
Benning et al.

(10) Patent No.: US 6,736,705 B2
(45) Date of Patent: May 18, 2004

(54) POLISHING PROCESS FOR GLASS OR CERAMIC DISKS USED IN DISK DRIVE DATA STORAGE DEVICES

(75) Inventors: Frederick P. Benning, Rochester, MN (US); Douglas Allan Kuchta, Rochester, MN (US); Steven L. Maynard, Rochester, MN (US); Jon Edward Podolske, Wabasha, MN (US)

(73) Assignee: Hitachi Global Storage Technologies (NL)

( * ) Notice: Subject to any disclaimer, the term of this patent is extended or adjusted under 35 U.S.C. 154(b) by 483 days.

(21) Appl. No.: 09/844,407

(22) Filed: Apr. 27, 2001

(65) Prior Publication Data

US 2002/0173222 A1 Nov. 21, 2002

(51) Int. Cl.[7] ..... B24B 1/00
(52) U.S. Cl. ..... 451/41; 451/36
(58) Field of Search ..... 451/28, 36, 37, 451/41, 57, 58, 59, 65, 259, 262, 268–271, 283, 285–288, 290, 291

(56) References Cited

U.S. PATENT DOCUMENTS 4,738,885 A * 4/1988 Matsumoto ..... 428/65.6
5,868,604 A * 2/1999 Atsugi et al. ..... 451/36
5,916,656 A * 6/1999 Kitayama et al. ..... 428/64.1
6,146,244 A * 11/2000 Atsugi et al. ..... 451/36
6,214,429 B1 * 4/2001 Zou et al. ..... 428/64.1
6,336,945 B1 * 1/2002 Yamamoto et al. ..... 51/309
6,371,834 B1 * 4/2002 Fujimura et al. ..... 451/41
6,391,779 B1 * 5/2002 Skrovan ..... 438/691
6,395,634 B1 * 5/2002 Miyamoto ..... 438/691
6,439,965 B1 * 8/2002 Ichino et al. ..... 451/36

FOREIGN PATENT DOCUMENTS

JP 11114826 A * 4/1999 ..... B24B/57/02
JP 2001030151 A * 2/2001 ..... B24B/7/17

* cited by examiner

*Primary Examiner*—Joseph J. Hail, III
*Assistant Examiner*—David B. Thomas
(74) *Attorney, Agent, or Firm*—Robert B. Martin; Bracewell & Patterson, L.L.P.

(57) ABSTRACT

Disk substrates are polished in a process which uses a single load of the disks to a polishing apparatus and a single polishing slurry. Preferably, the process varies at least one polishing parameter at multiple stages to achieve both a reasonable rate of removal during one stage and a smooth finished surface during another stage. Preferably, a fine grit cerium oxide slurry is used, along with a polishing pad having surface characteristics intermediate those of relatively hard pads typically used for material removal, and of relatively soft pads typically used for fine finishing. The polisher operates at high pressure and speed during a material removal stage, and then reduces speed and pressure during a finishing stage to achieve a suitable surface finish, without removing and cleaning disks between the two stages.

40 Claims, 5 Drawing Sheets

POLISHING PROCESS FOR GLASS OR CERAMIC DISKS USED IN DISK DRIVE DATA STORAGE DEVICES

FIELD OF THE INVENTION

The present invention relates to disk drive data storage devices, and in particular, to the manufacture of glass or ceramic disks for use in disk drive data storage devices.

BACKGROUND OF THE INVENTION

The latter half of the twentieth century has been witness to a phenomenon known as the information revolution. While the information revolution is a historical development broader in scope than any one event or machine, no single device has come to represent the information revolution more than the digital electronic computer. The development of computer systems has surely been a revolution. Each year, computer systems grow faster, store more data, and provide more applications to their users.

The extensive data storage needs of modem computer systems require large capacity mass data storage devices. While various data storage technologies are available, the rotating magnetic rigid disk drive has become by far the most ubiquitous. Such a disk drive data storage device is an extremely complex piece of machinery, containing precision mechanical parts, ultra-smooth disk surfaces, high-density magnetically encoded data, and sophisticated electronics for encoding/decoding data, and controlling drive operation. Each disk drive is therefore a miniature world unto itself, containing multiple systems and subsystem, each one of which is needed for proper drive operation. Despite this complexity, rotating magnetic disk drives have a proven record of capacity, performance and cost which make them the storage device of choice for a large variety of applications.

A disk drive typically contains one or more disks attached to a common rotating hub or spindle. Each disk is a thin, flat member having a central aperture for the spindle. Data is recorded on the flat surfaces of the disk, usually on both sides. A transducing head is positioned adjacent the surface of the spinning disk to read and write data. Increased density of data written on the disk surface requires that the transducer be positioned very close to the surface. Ideally, the disk surface is both very flat and very smooth. Any surface roughness or "waviness" (deviation in the surface profile from an ideal plane) decrease the ability of the transducing heads to maintain an ideal distance from the recording media, and consequently decrease the density at which data can be stored on the disk.

The disk is manufactured of a non-magnetic base (substrate), which is coated with a magnetic coating for recording data on the recording surfaces, and which may contain additional layers as well, such as a protective outer coating. Historically, aluminum has been the material of choice for the substrate. As design specifications have become more demanding, it is increasingly difficult to meet them using aluminum, and in recent years there has been considerable interest in other materials, specifically glass. Glass or ceramic materials are potentially superior to aluminum in several respects, and offers the potential to meet higher design specifications of the future.

One of the major drawbacks to the use of glass or ceramic disk substrates is the cost of their manufacture. Glass is currently used in some commercial disk drive designs, although generally at a higher cost than conventional aluminum. In a typical glass disk manufacturing process, the glass base material is initially formed in thin glass sheets. Multiple glass disks are then cut from a sheet. The process of forming the glass sheets leaves some waviness in the glass, and so the disks are typically lapped to reduce the waviness. Lapping leaves a thin fracture layer near the surface of the glass disks, which is unsuitable for use in disk drives. The fracture layer is therefore removed by a rough polishing step. The disks are then subjected to a second, fine polishing step to remove scratches and minor imperfections left by the rough polishing step and to achieve a suitably smooth finish. The glass substrate thus formed is then coated with a magnetic recording layer, and may be coated with other layers such as a protective layer.

Each of these steps adds to the cost of the disk. In particular, the polishing steps add significant cost. Polishing requires expensive equipment, substantial maintenance of the equipment, and significant handling. It is typically accomplished using a slurry containing cerium (in the form of cerium oxide, $Ce_2O_3$), an expensive rare earth element. Because two polishing steps are conventionally used, two polishing machines (or sets of machines) are required, and disks must be removed from one machine, thoroughly cleaned of all slurry, and loaded onto the second machine, to complete the polishing process.

Glass disks are currently significantly more expensive than conventional aluminum disks. Unless the cost of glass disk manufacture can be substantially reduced, it will be difficult to replace aluminum with glass and realize the potential benefits that glass disks offer.

SUMMARY OF THE INVENTION

In accordance with the present invention, the flat, data recording surfaces of glass or ceramic disk substrates for use in disk drive data storage devices are polished in a process which uses a single load of the disks to a polishing apparatus and a single polishing slurry. Preferably, the process varies at least one polishing parameter at multiple stages to achieve both a reasonable rate of removal during one stage and a smooth finished surface during another stage.

In the preferred embodiment, the substrate material is glass. The polishing slurry is a cerium oxide slurry having a grit approximating that used in a conventional second (fine) polishing step. A polishing pad has surface characteristics intermediate those of a relatively hard pad typically used for the initial rough polish step, and of a relatively soft pad typically used for the second fine polish step. After loading in the polishing machine, the pressure and speed of the polishers are gradually ramped up to high levels. The polisher operates at high pressure and speed during a material removal stage. When sufficient material has been removed, the polisher reduces speed and pressure during a finishing stage to achieve a suitable surface finish. The disks are not removed from the machine between the two stages, and the machine need not be stopped.

In the preferred embodiment, the disks are lapped before being subjected to polishing. The first stage (material removal stage) continues sufficiently long to remove the entire fracture layer left by the lapping process. Alternatively, the disks are not lapped after glass forming, and the first stage (material removal stage) is used instead to remove surface waviness in the disks.

By using a polishing process in accordance with the present invention, the number of polishing machines required is reduced, an intermediate cleaning step is unnecessary between two polishes, and disk handling is reduced, all contributing to a lowered cost of manufacture.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Overview of Disk Drive Design

Figure 1:
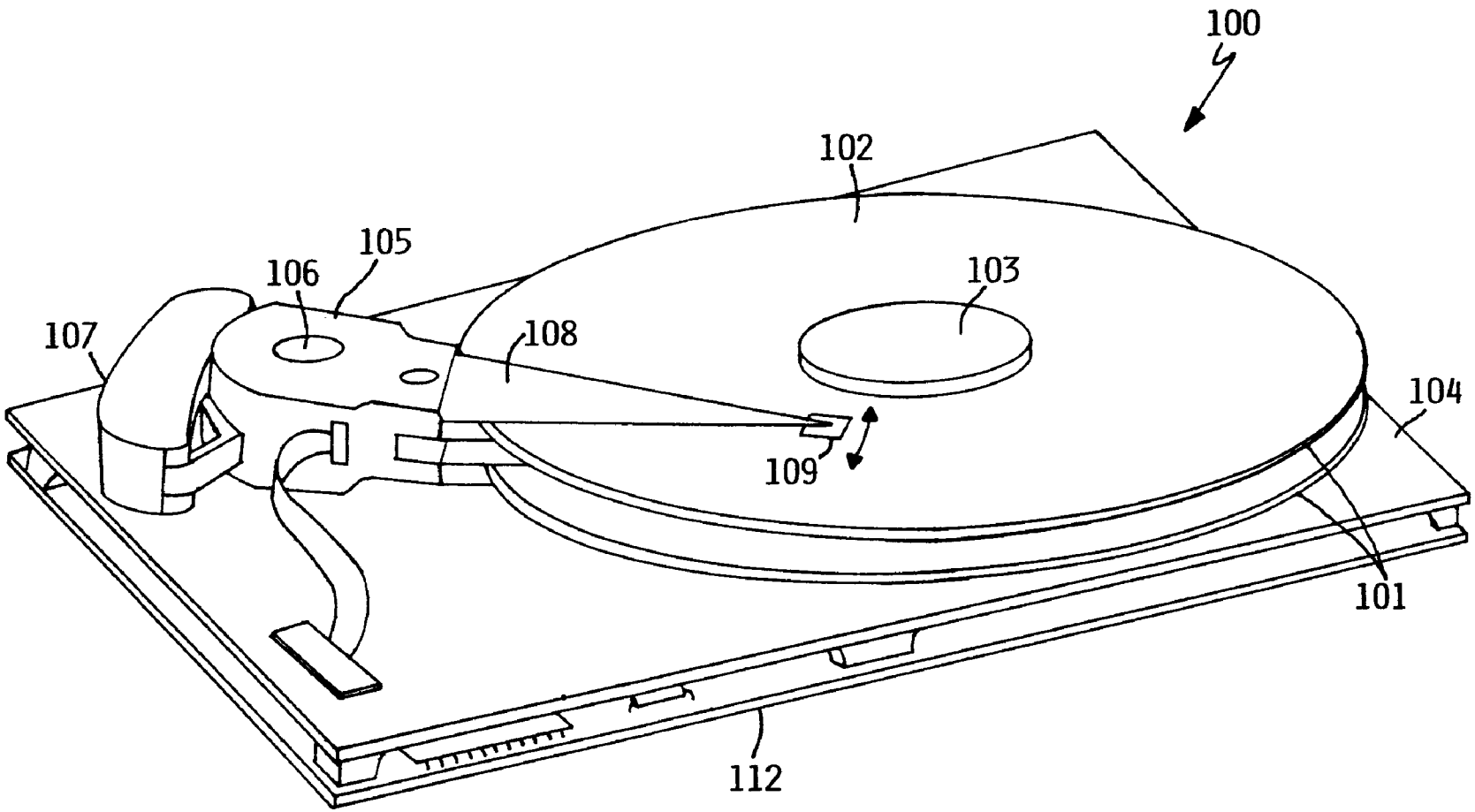
FIG. 1 is a simplified representation of a rotating magnetic disk drive storage device, in which disks manufactured in accordance with the preferred embodiment of the present invention are installed for use.

Referring to the Drawing, wherein like numbers denote like parts throughout the several views, FIG. 1 is a simplified drawing of the major components of a typical rotating magnetic disk drive storage device 100, in which disks manufactured in accordance with the preferred embodiment of the present invention are installed for use. Disk drive 100 typically contains one or more smooth, flat disks 101 which are permanently attached to a common spindle or hub 103 mounted to a base 104. Where more than one disk is used, the disks are stacked on the spindle parallel to each other and spaced apart so that they do not touch. The disks and spindle are rotated in unison at a constant speed by a spindle motor.

The spindle motor is typically a brushless DC motor having a multi-phase electromagnetic stator and a permanent magnet rotor. The different phases of the stator are sequentially driven with a drive current to rotate the rotor.

Each disk 101 is formed of a solid disk-shaped base or substrate, having a hole in the center for the spindle. The substrate has traditionally been aluminum, but other materials are possible, and in particular, according to the preferred embodiment, glass is used as the disk substrate material. The substrate is coated with a thin layer of magnetizable material, and may additionally be coated with a protective layer.

Data is recorded on the surfaces of the disk or disks in the magnetizable layer. To do this, minute magnetized patterns representing the data are formed in the magnetizable layer. The data patterns are usually arranged in circular concentric tracks, although spiral tracks are also possible. Each track is further divided into a number of sectors. Each sector thus forms an arc, all the sectors of a track completing a circle.

A moveable actuator 105 positions a transducer head 109 adjacent the data on the surface to read or write data. The actuator may be likened to the tone arm of a phonograph player, and the head to the playing needle. There is one transducer head for each disk surface containing data. The actuator usually pivots about an axis parallel to the axis of rotation of the disk(s), to position the head. The actuator typically includes a solid block surrounding a shaft or bearing 106 having comb-like arms extending toward the disk (which is, for this reason, sometimes referred to as the "comb"); a set of thin suspensions 108 attached to the arms, and an electromagnetic motor 107 on the opposite side of the axis. The transducer heads are attached to the end of the suspensions opposite the comb, one head for each suspension. The actuator motor rotates the actuator to position the head over a desired data track (a seek operation). Once the head is positioned over the track, the constant rotation of the disk will eventually bring the desired sector adjacent the head, and the data can then be read or written. The actuator motor is typically an electromagnetic coil mounted on the actuator comb and a set of permanent magnets mounted in a stationary position on the base or cover; when energized, the coil imparts a torque to the comb in response to the magnetic field created by the permanent magnets.

Typically, a servo feedback system is used to position the actuator. Servo patterns identifying the data tracks are written on at least one disk surface. The transducer periodically reads the servo patterns to determine its current deviation from the desired radial position, and the feedback system adjusts the position of the actuator to minimize the deviation. Older disk drive designs often employed a dedicated disk surface for servo patterns. Newer designs typically use embedded servo patterns, i.e., servo patterns are recorded at angularly spaced portions of each disk surface, the area between servo patterns being used for recording data. The servo pattern typically comprises a synchronization portion, a track identifying portion for identifying a track number, and a track centering portion for locating the centerline of the track.

The transducer head 109 is an aerodynamically shaped block of material (usually ceramic) on which is mounted a magnetic read/write transducer. The block, or slider, flies above the surface of the disk at an extremely small distance (referred to as the "flyheight") as the disk rotates. The close proximity to the disk surface is critical in enabling the transducer to read from or write the data patterns in the magnetizable layer, and therefore a smooth and even disk surface is required. Several different transducer designs are used. Many current disk drive designs employ a thin-film inductive write transducer element and a separate magnetoresistive read transducer element. The suspensions actually apply a force to the transducer heads in a direction into the disk surface. The aerodynamic characteristics of the slider counter this force, and enable the slider to fly above the disk surface at the appropriate distance for data access.

Various electrical components control the operation of disk drive 100, and are depicted mounted on circuit card 112 in FIG. 1, although they may be mounted on more than one circuit card, and the card or cards may be mounted differently.

It will be understood that FIG. 1 is intended as a simplified representation of a rotating magnetic disk drive, which is merely an example of a suitable environment for using a glass disk substrate produced in accordance with the preferred embodiment. It does not necessarily represent the sole environment suitable for such a glass disk.

DETAILED DESCRIPTION

In accordance with the preferred embodiment of the present invention, the polishing of the broad, flat surfaces of a glass disk substrate suitable for use, e.g., in a rotating magnetic disk drive data storage device, is accomplished in a single polishing step. By "single step", it is meant that the disk is loaded only once to a polishing apparatus, and polished to a smooth finish on a single machine during the single load. However, as described herein, this single "step" may be divided into multiple polishing stages in which the operating parameters of the polishing apparatus are varied, but which do not require that the disk be unloaded from the machine.

The polishing process therefore begins with a disk in which the broad, flat surfaces are in an unpolished state. This may or may not mean that the thin, cylindrical edges of the disk, at the outer diameter of the disk and at the inner diameter formed by the central aperture, have already been polished or otherwise finished. Generally, the finishing standards for the thin, cylindrical edges are different from those for the broad, flat surfaces, since data is not recorded on the surface of the edges. Techniques for finishing the thin cylindrical edges, as well as other aspects of the manufacture of a glass disk prior to polishing of the broad, flat surfaces, are known in the art, and are not the subject of the present invention. Any suitable method, now known or hereafter developed, may be used to manufacture the unpolished glass disk substrate.

As an example of a typical conventional technique, although not necessarily the only process by which an unpolished glass disk substrate may be fabricated, the following technique is briefly described. The unpolished disk is manufactured by first rolling thin glass sheets, much larger than a single disk. Disks are then cut from the thin glass sheets. Central disk apertures are cut in the disks at the same time the disks are cut from the sheets. Cutting leaves rough cylindrical edges at the aperture and outer edge of the disk. Although data is not recorded on these edges, the rough surface is generally deemed unsuitable, and so multiple process steps, such as grinding, followed by polishing, followed by chemical strengthening, may be employed to provide suitably smooth and strong cylindrical edges.

Figure 2:
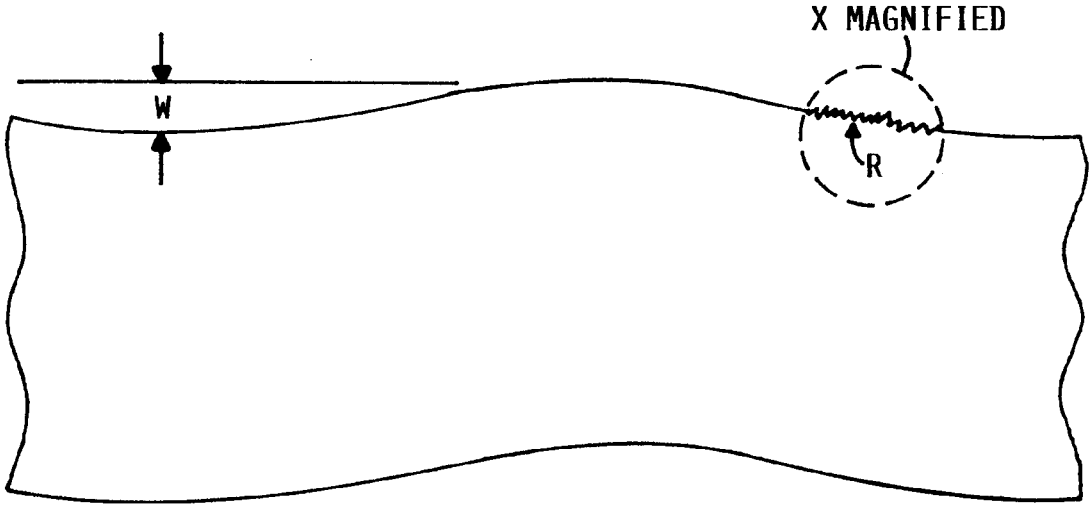
FIG. 2 illustrates the properties of waviness and surface roughness in a cross section of a portion of a glass disk substrate.

The various fabrication processes typically leave a certain amount of waviness in the broad flat surfaces of the disk, and a certain amount of surface roughness. FIG. 2 illustrates waviness (W) and surface roughness (R) in a cross section of a portion of a glass disk substrate. For illustrative purposes, waviness and roughness have been greatly exaggerated in the figure. As shown in FIG. 2, surface roughness is a property which expresses the average local surface irregularity. Waviness expresses the deviation of the surface from an ideal plane at a gross level. Either of these quantities can be measured in various ways. For consistency herein, surface roughness is expressed as measured by an atomic force microscope. Waviness is expressed as measured by a Phasemetrics Optiflat instrument measuring overall surface waviness.

For example, an unpolished glass disk substrate, after rolling, cutting and edge finishing, may have a typical waviness in excess of what can be measured using the Optiflat instrument, and therefore assumed to be far greater than 2 nm. Similarly, the surface roughness is also very rough, in excess of what is typically measured with an atomic force microscope, and therefore assumed to be far greater than 20 Å. It will be understood that these measurements are typical quantities given current commonly used glass fabrication processes, and that other fabrication processes, now known or hereafter developed, may yield unpolished glass disk substrates having different waviness or surface roughness characteristics.

The typical waviness and surface roughness characteristics of an unpolished disk above stated are generally considered far from acceptable for use in modem rotating magnetic disk drive data storage devices. It is believed that even a marginally acceptable disk substrate for use in a modem disk drive should have a waviness no greater than 2.0 nm and a surface roughness no greater than 15 Å. However, it is preferable that the waviness be no greater than 1.6 nm and the surface roughness be no greater than 12 Å. More specifically, it is desirable that the finishing process produce a disk having a nominal waviness of 0.8 nm or less, and a nominal surface roughness of 6 Å or less. As the demands of the marketplace continue to require increased storage density in disk drive storage devices, it is likely that these specifications will become more demanding in the future.

Figure 3:
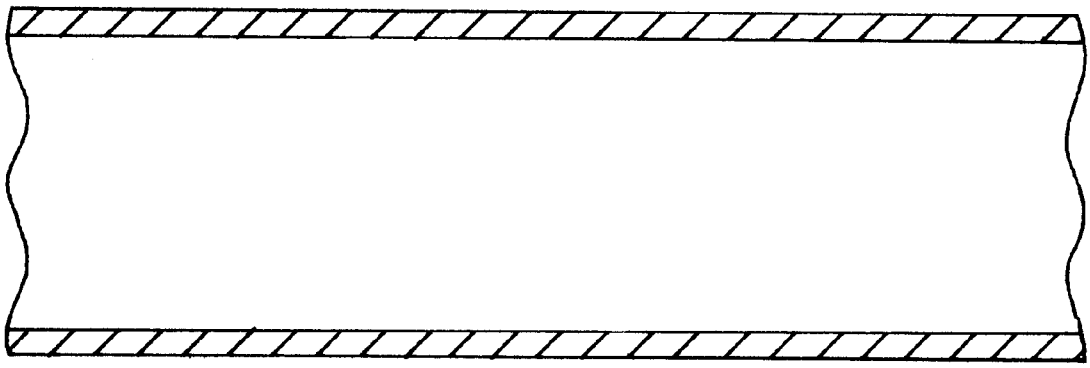
FIG. 3 illustrates a cross section of a portion of a typical disk substrate after lapping, showing fracture layers created by lapping, in accordance with the preferred embodiment.

In order to reduce waviness, it is common to lap the unpolished disk substrate to remove some of the material. Lapping rapidly removes material, but it also creates a thin fracture layer at the disk surface. A fracture layer is a portion the glass substrate near a surface in which numerous microscopic fractures exist. These are generated in the glass as a result of the rough lapping process. FIG. 3 illustrates a cross section of a portion of a typical disk substrate after lapping. As shown in FIG. 3, fracture layers 301, 302 are left at the opposite broad surfaces of the disk substrate after lapping. For illustrative purposes, the size of the fracture layer is exaggerated in FIG. 3. Typically, a fracture layer has a thickness (i.e., depth from the surface) of approximately 10–12 microns. Lapping may leave reduced amount of waviness.

While "lapping" is sometimes considered a form of coarse or rough polishing, for consistency of description, the term "polishing" as used herein refers only to processes which do not generate a significant fracture layer in the surface of the glass, and the term "lapping" is used to describe the more rough processes which may cause surface fractures.

A fracture layer is deemed unacceptable in a finished disk substrate for various reasons. Therefore, subsequent finishing steps must remove the fracture layer. Additionally, subsequent finishing steps must produce a surface having waviness and surface roughness characteristics within acceptable parameters.

Conventional glass substrate finishing processes have used at least two polishing steps to render an unpolished disk substrate which has been lapped as illustrated in FIG. 3 to a finished disk substrate, i.e., one in which waviness and surface roughness are within acceptable parameters as described above. At least one polishing step is used to remove material, and in particular, to remove the fracture layer. This first polishing step removes the fracture layer, but does not achieve acceptable surface roughness. Specifically, the polishing apparatus and its accessories (e.g. the polishing pads, the polishing slurry, etc.) provide an acceptable rate of material removal, but do not achieve a sufficiently smooth finish. The disk substrates are therefore removed from the first polishing apparatus, thoroughly cleaned, and subjected to a second polishing step in a different apparatus, using different slurries, pads and/or other materials). The second polishing step is used to remove fine scratches and achieve the required smooth finish.

Figure 4:
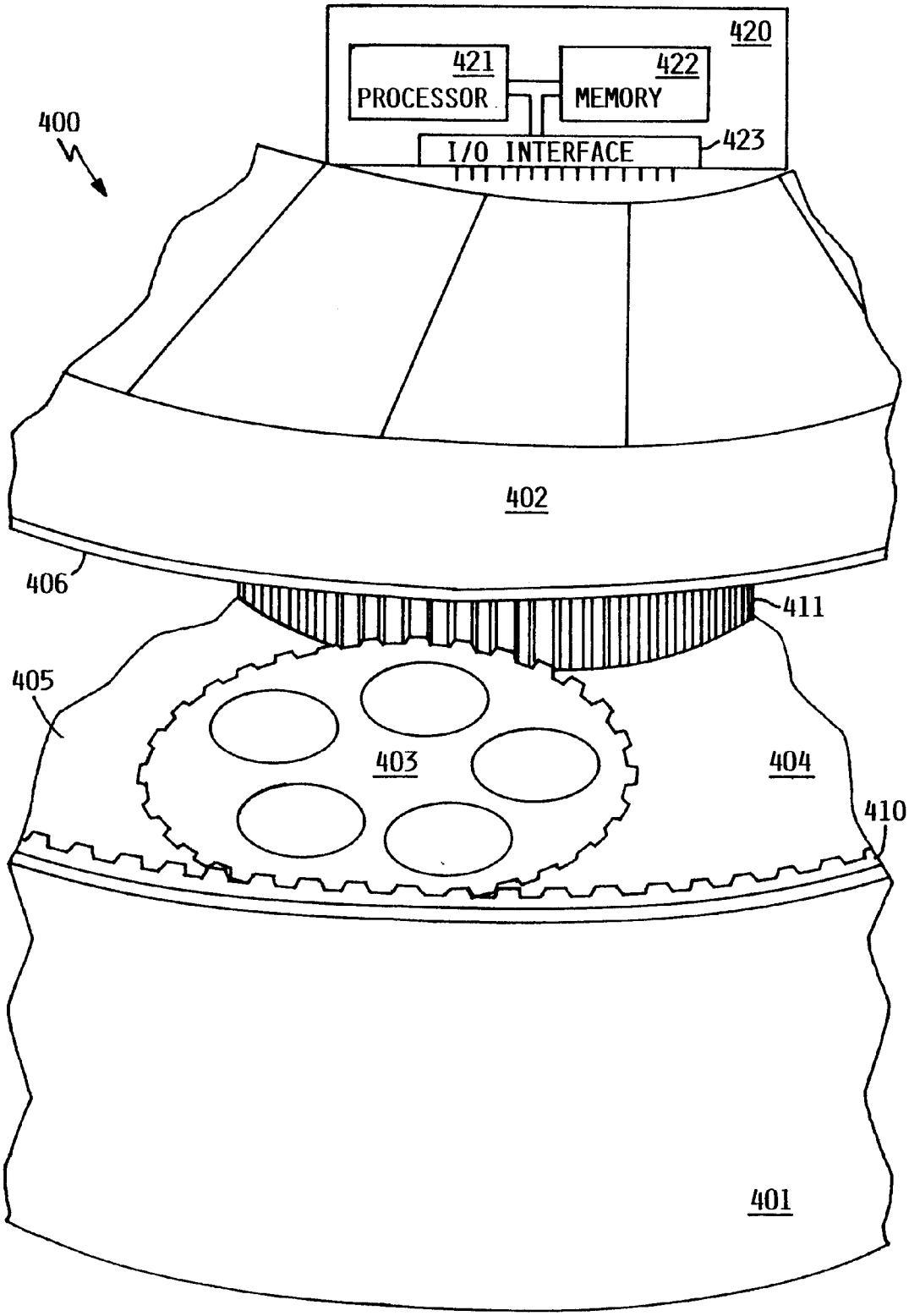
FIG. 4 shows the major components of a polishing apparatus for polishing a disk substrate, in accordance with the preferred embodiment.

In accordance with the preferred embodiment of the present invention, the unpolished disk substrate formed as described above (which is preferably lapped as described above after rolling the glass sheet and cutting the disk) is polished to a smooth finish (i,e, a finished surface having acceptable surface roughness and waviness, as described above) in a single polishing step. FIG. 4 shows the major components of a polishing apparatus according to the preferred embodiment. Polishing apparatus 400 comprises a cylindrical stationary base 401 having a vertical central axis, to which is mounted a rotating pressure plate assembly 402 which rotates about the central axis of the stationary base. The base forms a horizontal, flat annular polishing well 404. A cylindrical lip 410 at the top of the base having a toothed inner edge surrounds polishing well 404, defining its outer edge and containing a polishing slurry within the well. A central cylindrical shaft 411 coaxial with the central axis of the base forms the inner edge of the polishing well. The central cylindrical shaft has a toothed outer edge which rotates with the pressure plate assembly 402. Multiple polishing carriers 403 rest within the well (only one carrier is shown in FIG. 4 for clarity of illustration). Each carrier 403 is a thin, flat, disk-shaped member containing multiple circular holes and a toothed outer edge. Each hole within the carrier is slightly larger than a disk substrate. A flat annular polishing pad 405 is attached to base 401 and rests within well 404 underneath carrier 403. An identical flat annular polishing pad 406 is attached to pressure plate assembly 402.

In operation, one workpiece (i.e., an unpolished disk substrate) is placed in each hole of a carrier 403. Pressure plate assembly 402 is lowered to bring polishing pad 406 in proximity to the disk substrates. A polishing slurry is introduced into well 404 via a feed mechanism (not shown). The pressure plate assembly 402 and central cylindrical shaft 411 are then rotated. The teeth of carrier 403 engage the toothed outer edge of the central cylindrical shaft 411 and the toothed inner edge of the lip 410, giving the carrier a planetary gear motion as the central cylindrical shaft and pressure plate rotate. The speed of rotation and the pressure applied by pressure plate 402 to the disks are adjustable parameters of the polishing apparatus. The disks, being sandwiched between polishing pads 405 and 406, are subjected to essentially equal polishing pressure and polishing motion on both sides, so that both sides of the disk are polished simultaneously.

The polishing apparatus preferably contains a digital controller 420 (which is in fact a small, special purpose computer), comprising a programmable digital processor 421, a memory 422 for storing a control program which executes on processor 421 to control the operation of the polisher, and an I/O interface 423 which interfaces with input means (not shown) by which an operator may enter data into the controller, and various sensors which also provide input, and output devices such as status displays which provide information to the operator, and motors, solenoids and the like which operate the polisher. The input means may be any of various input means known in the art, such as keyboards, keypads, pointer devices, etc., and may also be input means for stored digital data in computer readable form such as a floppy disk drive, CD-ROM drive, serial communications port, etc.

A suitable polishing apparatus for use in accordance with the preferred embodiment of the present invention is a Peter Wolters model AC320 polisher. While a specific type of polishing apparatus is disclosed, it is understood that other types of polishing apparatus could be used.

Preferably, polishing a disk substrate from an unpolished state to an acceptable surface finish (i.e., a surface having acceptable roughness and waviness characteristics as explained above, including a roughness of no more than 15 Å and a waviness of no more than 2.0 nm) is achieved in a single step on a single polishing machine by using a cerium oxide ($Ce_2O_3$) slurry approximating that used in a conventional second or fine polishing step (i.e., a polishing step following the removal of the fracture layer). The polishing pad has surface characteristics intermediate those of a relatively hard type of pad typically used for the conventional first polishing step (i.e., the polishing step which removes the fracture layer), and of a relatively soft pad typically used for the second or fine polishing step. The polishing apparatus is loaded with unpolished disk substrates, and brought to a high rotational speed and high applied pressure during a first stage. The fracture layer is removed during this first stage. After sufficient time in the polisher to remove the fracture layer, the rotational speed and applied pressure are reduced, and the polisher continues to operate in a second stage. This second stage achieves a fine surface finish. It is to be noted that both stages are accomplished on the same polishing apparatus, using the same polishing pads and polishing slurry. The disks are not removed from the machine between the two stages. A specific description of the process parameters follows.

The polishing slurry is formed by mixing a polishing powder composition with de-ionized water. The primary ingredient in the powder composition is cerium oxide ($Ce_2O_3$). Cerium is a rare earth element, and the polishing powder is relatively expensive. In the preferred embodiment, acceptable results are obtainable by using a fine polishing powder having a particle size of 0.5 $\mu$m (average) and containing approximately 60% cerium oxide by weight. The remaining powder composition is primarily other rare earth oxides of the Lanthanide series (e.g., $Nd_2O_3$, $La_2O_3$, $Pr_6O_{11}$) and rare earth fluorides (e.g., $NdF_3$). Such a slurry powder is available commercially as Mirek Elo slurry, from Mitsui Mining and Smelting Co. Various alternative powder or liquid slurry compositions are available from other suppliers, some of which may contain different concentrations of cerium oxide and/or additives such as surfactants or suspension agents. The Mirek Elo slurry composition provides adequate results, and is used in the preferred embodiment primarily due to cost considerations. The various other rare earth oxides and fluorides in the slurry powder are inferior in performance characteristics to cerium oxide, but refined slurries containing higher percentages of cerium oxide are significantly more expensive. Slurries containing higher percentages of cerium oxide can be expected to provide better performance, and could alternatively be used. It is possible that lower concentrations of cerium oxide will provide acceptable results, but it is expected that they would increase the process time, and would last for fewer polishing runs.

The slurry powder is initially mixed with water to a concentration of approximately 12 Baume. It is recommended that slurry be re-used from one polishing run to the next in order to reduce cost. The slurry concentration gradually drops as the slurry is re-used. A concentration in the range of 8–12 Baume is considered acceptable, it being understood that this range may vary with changes in other process parameters. At some point, the slurry gets sufficiently contaminated from ground glass and diluted from various effects that it must be replaced with new slurry. It is recommended that slurry be replaced after approximately 30–40 polishing runs using the equipment and parameters stated herein as the preferred embodiment, it being understood that the number of polishing runs attainable may vary as various process parameters are changed.

The selection of appropriate polishing pad is a crucial parameter. A hard pad leaves unacceptable scratches in the surface of the disk due to embedded particles, while a soft pad does not achieve sufficient material removal rates, has a tendency to conform to waviness in the surface, making it difficult to reduce waviness to acceptable levels, and also has a short life under high pressure polishing. In the preferred embodiment, the polishing pads have characteristics intermediate those of pads commonly used in a conventional material removal polishing step (relatively hard) and those of pads commonly used in a conventional fine polishing step (relatively soft). An acceptable material removal rate is achieved by using a relatively high pressure with this pad, while the low pressure polishing stage and fine slurry make a fine finish possible. Specifically, in the preferred embodiment the pads are commercially available as Fujibo H9900 PET-#2 polishing pads. These pads have a hardness of 63.0° D, a density of 0.5 g/cm$^3$, a compressibility of 20.7%, a pore density of 13,800/cm$^2$, and an average pore diameter of 41.4 $\mu$m, all quantities as specified by the supplier. However, it should be understood that other commercially available pads or custom fabricated pads may also provide acceptable results. In general, pads having similar characteristics to those stated above can be expected to produce acceptable results, but since different pad models vary considerably in their life and performance characteristics under certain conditions, any specific pad model should be verified under actual operating conditions.

Figure 5:
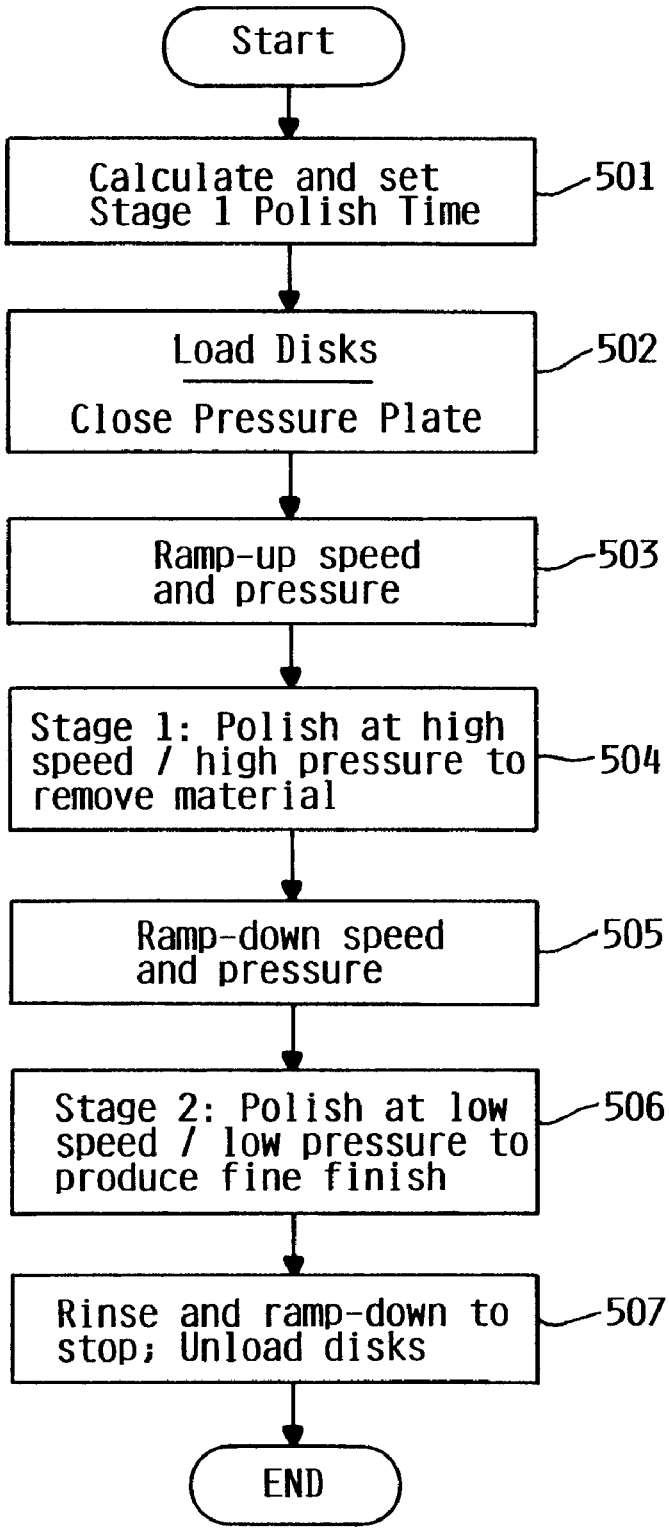
FIG. 5 is a process flow diagram illustrating the polishing process, according to the preferred embodiment.
Figure 6:
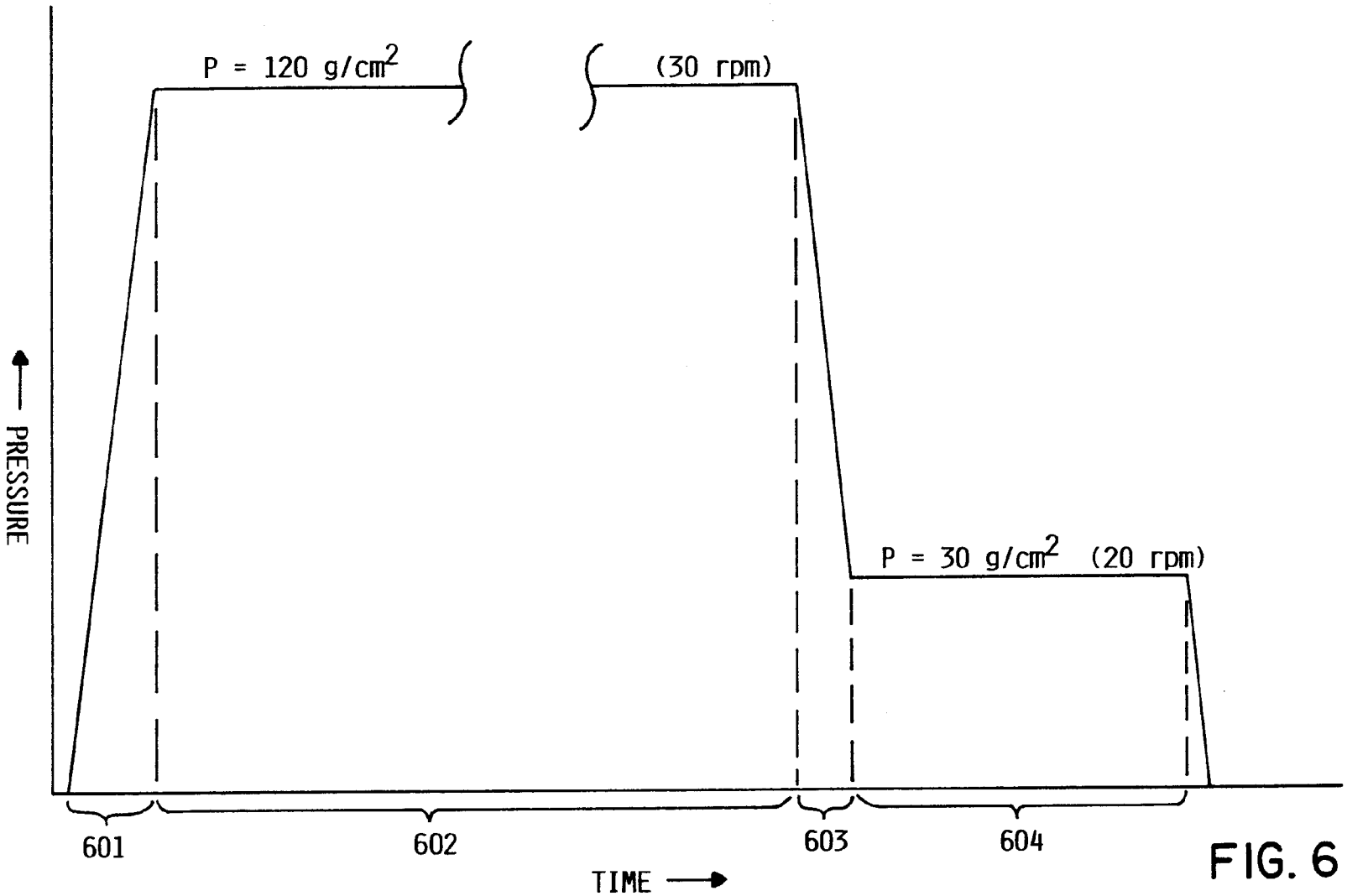
FIG. 6 is a timeline showing the variation of polishing machine pressure and speed with time during the polishing process, according to the preferred embodiment.

In the preferred embodiment, a two-stage polishing process is performed on a single load of the disks to a single polishing apparatus. FIGS. 5 and 6 illustrate this process. FIG. 5 is a process flowchart showing the different parts of the polishing process. FIG. 6 is a timeline showing the variation of polishing machine pressure and speed with time during the polishing process. The control parameters which control the operation of the polisher are loaded into memory 422 beforehand, and the polishing apparatus 400 thus configured automatically performs the process described herein.

As shown in FIG. 5, an operator first determines the length of time needed for the material removal stage of the polishing run, and inputs this parameter to controller 420 (block 501 ). In the preferred embodiment, the polisher is operated in stage 1, (the material removal stage, described below) a variable length of time, the time being re-computed at the beginning of each run. Typically, this length of time is in the range of 30–40 minutes. The time varies for each run because the thickness of disk substrates vary, and because the quality of polishing slurry degrades as it ages, slowing the rate of material removal. The first stage should last a sufficiently long time to remove the entire fracture layer, and achieve the desired final disk substrate thickness per disk specifications. In the preferred embodiment, the disk substrate after polishing should have a thickness of 1.0 mm. Typically, about 50 microns of material thickness are removed during polishing (i.e., about 25 microns from each side of the disk substrate). Each fracture layer is typically about 10–12 microns in thickness on each side of the substrate, and with 25 microns typically being removed, this is sufficient to assure removal of the entire fracture layer.

Disk substrate thickness is measured before and after each polishing run. From the change in substrate thickness during the immediately preceding run on the same polisher, and the known process time during the material removal stage, the rate of removal may be computed as a simple quotient. The thickness of the substrate is measured for the current polishing run, and the thickness of material desired to be removed is computed as the difference between current thickness and specification. The desired process time in stage 1 is then computed as the thickness of material to be removed divided by the rate of removal determined for the previous run. I.e.:

$$T1_N = \frac{(D_{Start(N)} - D_{Spec})}{Q_{(N-1)}} = \frac{T1_{(N-1)} * ((D_{Start(N)} - D_{Spec})}{(D_{Start(N-1)} - D_{End(N-1)})}$$

where $T1_N$ is the amount of process time in stage 1 for the Nth polishing run, $D_{Start(N)}$ and $D_{End(N)}$ are the measured disk substrate thicknesses at the start and end of the Nth polishing run, respectively, $D_{Spec}$ is the finished disk thickness per specification, and $Q_N$ is the measured rate of removal for polishing run N.

A plurality of unpolished disk substrates, formed as described above, are loaded to polishing apparatus 400 by placing the disks in corresponding holes of carriers 403 in the polishing well 404, so that the disks are resting on polishing pad 405 (block 502 ). The pressure plate assembly 402 is then lowered to bring polishing pad 406 in proximity with the disks.

The polisher is then started in a ramp-up mode, in which the rotational speed of the pressure plate assembly 402 and the downward pressure applied by the pressure plate assembly to the disks are gradually increased (block 503 ). While operating, whether in the ramp-up mode or in any of the subsequent phases of operation, the polisher feeds the polishing slurry described above to the polishing well via an automatic feed mechanism. Referring to FIG. 6, the ramp-up period is illustrated as 601. Preferably, the ramp-up time takes approximately 1.0 min., and is shown in FIG. 6 running from time 0 to time 1 min Ideally, the polishing apparatus would continuously increase speed and pressure during the ramp up stage, as illustrated in FIG. 6. However, certain polishing machines, and in particular, the polishing apparatus used in the preferred embodiment, can not be conveniently operated to increase speed and pressure on a continuous basis. As a substitute, it is acceptable to increase speed and pressure in increments. In the preferred embodiment, the polishing pressure and speed are incremented three times to ramp up from a starting (stationary) state to the high speed, high pressure material removal stage.

At the end of ramp-up, the polisher is operating at a rotational speed of approximately 30 rpm and applying a pressure on the disks of approximately 120 g/cm$^2$. The polisher maintains this rotational speed and pressure during the first, or material removal, stage of polishing (block 504 ). The first stage is illustrated in FIG. 6 as 602. The first stage lasts a variable length of time calculated and specified by the operator, as described above with respect to block 501. This time period is sufficiently long to remove the entire fracture layer. When the polisher is operated using the process parameters described herein, it will remove glass from each side of the disk at a rate of approximately 0.75 microns/min, and a layer approximately 25 microns thick will be removed from each side of the disk. This amount of material removal is considered sufficient to assure removal of the entire fracture layer. While in the preferred embodiment the polisher operates at stage 1 for pre-computed length of time as described above, it would alternatively be possible to operate the polisher for a fixed length of time which does not vary, or to measure the actual material removal and halt the stage 1 polishing process after a pre-determined thickness of material has been removed.

The optimal operating pressure during stage 1 using the apparatus and parameters stated herein is believed to range from approximately 100 g/cm$^2$ to 160 g/cm$^2$. Higher pressures result in a faster rate of material removal, but create greater stresses on the pads and other components. Pressures significantly higher than 160 g/cm$^2$ produce unacceptably rapid deterioration of the pads. In the preferred embodiment, a pressure of 120 g/cm$^2$ has been adopted as a reasonable compromise between the need to reduce process time and the need to conserve materials, but other pressures could be used. It should also be understood that different pads or changes in other process parameters might call for a different pressure during the material removal stage.

After completion of the first stage (material removal stage), the polisher gradually reduces speed and pressure to second stage levels, described below (block 505 ). This ramp-down phase is illustrated in FIG. 6 as 603. Preferably, the ramp-down takes approximately 0.5 min. As in the case of ramp-up, ramp-down is actually performed in increments when using the polishing apparatus of the preferred embodiment, although different machines may support a continuous ramping down.

The polisher then holds rotational speed of the pressure plate assembly and polishing pressure constant during a second, or fine polishing, stage (block 506 ). This fine polishing stage is illustrated in FIG. 6 as 604. Preferably, the polisher is operated at a rotational speed of approximately 20 rpm and a pressure of approximately 30 g/cm$^2$ during this second stage. The polisher is operated at these parameters for a fixed period of approximately 5 minutes. The purpose of the second stage is to remove small scratches which may have been left by the high operating pressures of the first stage, leaving a fine surface finish. A negligible amount of material is removed during this second stage. Specifically, after completion of the second polishing stage, the finish should have a surface roughness no greater than 12 Å. It is expected that it will be possible to achieve a typical surface roughness of 6 Å or better using the above described process. The finished disk should have a waviness no greater than 1.6 nm, and it is expected that it will be possible to achieve a typical waviness of 0.8 nm or better using the above described process. This level of waviness is typically achieved by the first stage of polishing.

As in the case of stage 1 polishing, the operating pressure during stage 2 may vary, and is typically about ¼ the pressure during stage 1. I.e., typical pressures during the second stage would range from approximately 25 g/cm$^2$ to 40 g/cm$^2$, a pressure of 30 g/cm$^2$ being used in the preferred embodiment. Although specific ranges and optimum pressures have been specified herein, it should be understood that these are by way of describing a single embodiment only, and that different materials and process conditions may require pressures outside the ranges stated herein.

After a short rinse segment, the polishing machine is then gradually brought to a halt, and the polished disks are unloaded (block 507 ). The polished disk substrates are subsequently cleaned of any residual polishing slurry or other contaminant. The glass disk substrate as thus finished merely provides a base for fabrication of the completed data recording disk which is assembled into a disk drive data storage device, and the polished substrate will typically be subjected to additional process steps (which are not the subject of the present invention) to produce a completely fabricated recording disk. For example, in the case of a rotating magnetic disk drive, the glass disk substrate manufactured as described above will typically be subjected to a sputtering process to deposit a thin magnetic layer on the glass substrate, and may be given a protective overcoat layer or subjected to other fabrication processes as well.

It will be understood by those skilled in the art that certain trade-offs exist among many of the process parameters described above, and that the parameters described above as part of the preferred embodiment are but one example of a set of possible parameters, which are believed to give a relatively low total process cost given currently available cost constraints. Many variations exist which could produce acceptable finished disk substrates, but which would vary the components of the total process cost. For example, if the operating pressure of the pressure plate is reduced during polishing stage 1 (material removal stage), it can be expected that material will be removed at a slower rate and the material removal stage will take longer to complete. Notwithstanding the longer process time, this might be considered desirable due to some other consideration, e.g., increasing the life of the polishing pads, the carriers and the slurry. The decision whether to reduce pressure during stage 1 may therefore depend on the relative cost of the polishing machine and operator time versus the polishing pads, carriers and slurry. From a technical standpoint, neither approach is inherently superior to the other, and the lowest cost approach could depend on market conditions, which may be variable. If the cost of slurry suddenly increases, it may be desirable to alter certain process parameters to conserve slurry at the expense of other process components.

In the preferred embodiment, an unpolished glass disk is formed by rolling a glass sheet, cutting disks from the sheet, finishing the disk edges, and lapping the broad, flat disk surfaces to reduce the waviness, these steps being performed before the single step polishing method herein described. However, an unpolished glass disk may alternatively be formed by different processes, either now existing or hereafter developed. Additionally, the order in which process steps are performed may be altered.

As one specific alternative for forming an unpolished glass disk substrate, although by no means the only such alternative, the lapping process may be omitted. If lapping is not performed, the unpolished disk substrate will generally have greater waviness, although it may have a reduced fracture layer or no fracture layer. The one-step polishing process as described herein may be employed to remove material from an untapped disk substrate in order to reduce waviness. I.e., in the first polishing stage described above, which is performed at relatively high polishing speed and pressure, the stage continues until sufficient material has been removed to reduce waviness below some acceptable amount, such as 2.0 nm. The second stage then proceeds as described above to achieve an acceptable fine surface finish. It may be necessary to vary some of the polishing parameters from those above described, and in particular, to vary the polishing time during the first stage of polishing, in order to achieve sufficient removal of material to reduce waviness to acceptable levels.

As described herein, a single-step polishing process for a glass disk substrate is capable of producing disk substrates having a finished surface roughness no greater than 12 Å, and preferably disk substrates which have a typical surface roughness of approximately 6 Å or less. Such a surface finish is typically sufficient for most disk drive designs in use today. However, it can be expected that in the future there may be a need for even smoother disk surface finishes. In particular, some interest has been shown in disks having a "superfinished" surface, in which surface roughness is less than 4 Å, and is preferably typically 2 Å or less. The grit of the polishing powder used in the preferred embodiment is too coarse to achieve such a superfinish. However, processes do exist whereby a glass disk substrate finished in accordance with the preferred embodiment can be subjected to a further superfinishing polishing step to reduce the surface roughness to less than 4 Å. Such additional polishing can therefore be used in conjunction with the present invention to produce a superfinished surface on a glass disk substrate.

An example of such a superfinishing process is described in commonly assigned U.S. patent application Ser. No. 08/184,718, filed Jan. 21, 1994, entitled "Substrate Independent Superpolishing Process and Slurry", which is herein incorporated by reference.

The process of producing a disk substrate is described herein with respect to glass disk substrates, which at present is the material of choice. However, at least some ceramic materials or glass ceramic materials are also potentially suitable for use as substrates in disk drive storage devices. It is known that cerium oxide will satisfactorily abrade certain such materials, and it is therefore expected that the process described herein may be applicable to at least some such ceramic or glass ceramic materials. However, some of the process parameters, such as process times in the various stages, polishing pressure, and so forth, may be altered to achieve optimum results with different materials. Certain ceramic or glass ceramic materials have properties which are potentially superior to glass, e.g., higher strength or higher temperature stability. The high cost of manufacture currently discourages use of such materials, but it is foreseeable that such materials may become employed in disk drives in the future, particularly if processes for reducing the cost of manufacture can be found. As used herein, "glass or ceramic" shall include materials which are either glass or ceramic or some combination of glass and ceramic.

As described earlier, a disk substrate produced in accordance with the preferred embodiment is suitable for use in a rotating magnetic disk drive data storage device. However, such an application is not necessarily the only application in which a glass or ceramic disk substrate produced in accordance with the present invention may be used. For example, there may be other data recording techniques, now known or hereafter developed, which require a smooth, flat disk substrate. Data may, e.g. be recorded on smooth, flat disk surfaces in an optically encoded form, or in some other form. In this case, there may be certain variations in disk structure from those described above, e.g., the absence of a magnetizable layer. Additionally, there may be other layers not described herein, either now known or hereafter developed, which are deposited over the glass or ceramic disk substrate after manufacture of the substrate in accordance with the present invention.

In general, the routines executed to implement the illustrated embodiments of the invention, whether implemented as part of an operating system or a specific application, program, object, module or sequence of instructions are referred to herein as "programs" or "control programs". The programs typically comprise instructions which, when read and executed by one or more processors in the devices or systems in a computer system consistent with the invention, cause those devices or systems to perform the steps necessary to execute steps or generate elements embodying the various aspects of the present invention. Moreover, while the invention has and hereinafter will be described in the context of fully functioning digital devices such as disk drives, the various embodiments of the invention are capable of being distributed as a program product in a variety of forms, and the invention applies equally regardless of the particular type of signal-bearing media used to actually carry out the distribution. Examples of signal-bearing media include, but are not limited to, recordable type media such as volatile and non-volatile memory devices, floppy disks, hard-disk drives, CD-ROM's, DVD's, magnetic tape, and transmission-type media such as digital and analog communications links, including wireless communications links. Examples of signal-bearing media are illustrated in FIG. 4 as memory 422.

Although a specific embodiment of the invention has been disclosed along with certain alternatives, it will be recognized by those skilled in the art that additional variations in form and detail may be made within the scope of the following claims:

What is claimed is:

1. A method for manufacturing a glass or ceramic disk substrate for a rotating disk drive data storage device, comprising the steps of:

providing an unpolished glass or ceramic disk substrate;

loading said unpolished disk substrate to a polishing apparatus;

polishing at least one flat surface of said unpolished disk substrate to a finished state suitable for use in a disk drive data storage apparatus using said polishing apparatus, said polishing step being accomplished without intermediate unloading of said disk substrate; and wherein said polishing step comprises a plurality of stages, including a first stage for polishing said unpolished disk substrate at a first polishing speed and a first polishing pressure, and a second stage for polishing said unpolished disk substrate as a second polishing speed and a second polishing pressure, said second stage being performed after said first stage, said second polishing speed being less than said first polishing speed and said second polishing pressure being less than said first polishing pressure.

2. The method for manufacturing a glass or ceramic disk substrate of claim 1, wherein said disk drive data storage device is a rotating magnetic disk drive data storage device, said disk substrate being subsequently coated with a magnetic coating after said polishing step.

3. The method for manufacturing a glass or ceramic disk substrate of claim 1, wherein said disk substrate is glass.

4. The method for manufacturing a glass or ceramic disk substrate of claim 1, wherein said polishing step polishes said disk substrate in the presence of a polishing slurry containing cerium oxide.

5. The method for manufacturing a glass or ceramic disk substrate of claim 1, wherein opposite flat surfaces of said disk substrate are simultaneously polished during said polishing step.

6. The method for manufacturing a glass or ceramic disk substrate of claim 5, wherein a plurality of said disk substrates are simultaneously polished in a polishing apparatus, said polishing apparatus comprising a polishing well containing a said plurality of disk substrates, a pair of opposed polishing pads for simultaneously polishing opposite surfaces of said disk substrates, a rotating pressure plate for applying pressure to and rotating one of said polishing pads, and at least one moving carrier for carrying one or more disk substrates, said at least one moving carrier lying between said pair of opposed polishing pads.

7. A method for manufacturing a glass or ceramic disk substrate for a rotating disk drive data storage device, comprising the steps of:

providing a glass or ceramic disk substrate in an unpolished state; loading said disk substrate in said unpolished state to a polishing apparatus;

polishing said disk substrate with said polishing apparatus from said unpolished state to a surface finish having a roughness no greater than 15 Å, as measured by an atomic force microscope, said polishing step being accomplished without intermediate unloading of said disk substrate; and wherein said polishing step comprises a plurality of stages, including a first stage for polishing said unpolished disk substrate at a first polishing speed and a first polishing pressure, and a second stage for polishing said unpolished disk substrate as a second polishing speed and a second polishing pressure, said second stage being performed after said first stage, said second polishing speed being less than said first polishing speed and said second polishing pressure being less than said first polishing pressure.

8. The method for manufacturing a glass or ceramic disk substrate of claim 7, wherein said polishing step polishes said disk substrate from said unpolished state to a surface finish having a roughness no greater than 12 Å, as measured by an atomic force microscope.

9. The method for manufacturing a glass or ceramic disk substrate of claim 8, wherein said polishing step polishes said disk substrate from said unpolished state to a surface finish having a roughness no greater than 6 Å, as measured by an atomic force microscope.

10. The method for manufacturing a glass or ceramic disk substrate of claim 7, wherein said disk drive data storage device is a rotating magnetic disk drive data storage device, said disk substrate being subsequently coated with a magnetic coating after said polishing step.

11. The method for manufacturing a glass or ceramic disk substrate of claim 7, wherein said polishing step polishes said disk substrate in the presence of a polishing slurry containing cerium oxide.

12. A method for polishing a glass or ceramic disk substrate for a rotating disk drive data storage device, comprising the steps of:

loading a glass or ceramic disk substrate to a polishing apparatus;

polishing at least one flat surface of said disk substrate with said polishing apparatus using a polishing slurry composition in a first polishing stage, said polishing apparatus operating at a first pressure during said first polishing stage;

polishing said at least one flat surface of said disk substrate with said polishing apparatus using said polishing slurry composition in a second polishing stage, said polishing apparatus operating at a second pressure lower than said first pressure during said second polishing stage, said second polishing stage being performed after said first polishing stage and without intermediate unloading of said disk substrate; and wherein said first polishing pressure is between 100 g/cm2 and 160 g/cm2, and said second polishing pressure is no more than 40 g/cm2.

13. The method for manufacturing a glass or ceramic disk substrate of claim 12, wherein said disk drive data storage device is a rotating magnetic disk drive data storage device, said disk substrate being subsequently coated with a magnetic coating after said polishing step.

14. The method for manufacturing a glass or ceramic disk substrate of claim 12, wherein said polishing slurry composition comprises cerium oxide.

15. The method for manufacturing a glass or ceramic disk substrate of claim 12, wherein said disk substrate is glass.

16. The method for manufacturing a glass or ceramic disk substrate of claim 12, wherein said step of polishing said disk substrate wit said polishing apparatus in a first polishing stage comprises operating said polishing apparatus at a first polishing speed; and wherein said step of polishing said disk substrate with said polishing apparatus in a second polishing stage comprises operating said polishing apparatus at a second polishing speed lower than said first polishing speed.

17. The method for manufacturing a glass or ceramic disk substrate of claim 12, wherein said polishing apparatus simultaneously polishes opposite flat surfaces of a plurality of said disk substrates, said polishing apparatus comprising a polishing well containing a said plurality of disk substrates, a pair of opposed polishing pads for simultaneously polishing opposite surfaces of said disk substrates, a rotating pressure plate for applying pressure to and rotating one of said polishing pads, and at least one moving carrier for carrying one or more disk substrates, said at least one moving carrier lying between said pair of opposed polishing pads.

18. A method for manufacturing a glass or ceramic disk substrate for a rotating disk drive data storage device, comprising the steps of:

loading a glass or ceramic disk substrate to a polishing apparatus, said disk substrate having a fracture layer on at least one flat surface thereof;

polishing said disk substrate with said polishing apparatus to a state in which substantially all of said fracture layer is removed from said at least one flat surface and in which said at least one flat surface has a surface roughness no greater than 15 Å, as measured by an atomic force microscope, said polishing step being accomplished without intermediate unloading of said disk substrate: and wherein a polishing pressure of approximately 30 g/cm2 is used during at least a portion of the polishing step.

19. The method for manufacturing a glass or ceramic disk substrate of claim 18, wherein said polishing step polishes said disk substrate from said unpolished state to a surface finish having a roughness no greater than 12 Å, as measured by an atomic force microscope.

20. The method for manufacturing a glass or ceramic disk substrate of claim 19, wherein said polishing step polishes said disk substrate from said unpolished state to a surface finish having a roughness no greater than 6 Å, as measured by an atomic force microscope.

21. The method for manufacturing a glass or ceramic disk substrate of claim 18, wherein said disk drive data storage device is a rotating magnetic disk drive data storage device, said disk substrate being subsequently coated with a magnetic coating after said polishing step.

22. The method for manufacturing a glass or ceramic disk substrate of claim 18, wherein said disk substrate is glass.

23. The method for manufacturing a glass or ceramic disk substrate of claim 18, wherein said polishing step comprises a plurality of stages, including a first stage for polishing said unpolished disk substrate at a first polishing speed and a first polishing pressure, and a second stage for polishing said unpolished disk substrate as a second polishing speed and a second polishing pressure, said second stage being performed after said first stage, said second polishing speed being less than said first polishing speed and said second polishing pressure being less than said first polishing pressure.

24. The method for manufacturing a glass or ceramic disk substrate of claim 18, wherein said polishing step polishes said disk substrate in the presence of a polishing slurry containing cerium oxide.

25. A method for manufacturing a glass or ceramic disk substrate for a rotating disk drive data storage device, comprising the steps of:

loading a glass or ceramic disk substrate to a polishing apparatus;

polishing at least one flat surface of said disk substrate with said polishing apparatus to remove at least 12 microns of material from said at least one flat surface, and to a state in which said at least one flat surface has a surface roughness no greater than 15 Å, as measured by an atomic force microscope, said polishing step being accomplished without intermediate unloading of said disk substrate.

26. The method for manufacturing a glass or ceramic disk substrate of claim 25, wherein said polishing step polishes said disk substrate from said unpolished state to a surface finish having a roughness no greater than 12 Å, as measured by an atomic force microscope.

27. The method for manufacturing a glass or ceramic disk substrate of claim 26, wherein said polishing step polishes said disk substrate from said unpolished state to a surface finish having a roughness no greater than 6 Å, as measured by an atomic force microscope.

28. The method for manufacturing a glass or ceramic disk substrate of claim 25, wherein said polishing apparatus removes approximately 25 microns of material or more from said at least one flat surface during said polishing step.

29. The method for manufacturing a glass or ceramic disk substrate of claim 25, wherein said polishing apparatus simultaneously removes at least 12 microns of material from each of two opposite Rat surfaces of said disk substrate during said polishing step.

30. The method for manufacturing a glass or ceramic disk substrate of claim 25, wherein said disk drive data storage device is a rotating magnetic disk drive data storage device, said disk substrate being subsequently coated wit a magnetic coating after said polishing step.

31. The method for manufacturing a glass or ceramic disk substrate of claim 25, wherein said polishing step comprises a plurality of stages, including a first stage for polishing said unpolished disk substrate at a first polishing speed and a first polishing pressure, and a second stage for polishing said unpolished disk substrate as a second polishing speed and a second polishing pressure, said second stage being performed after said first stage, said second polishing speed being less than said first polishing speed and said second polishing pressure being less than said first polishing pressure.

32. A method for manufacturing a glass disk substrate for a rotating disk drive data storage device, comprising the steps of:

providing a glass disk substrate in an unpolished state;

loading said disk substrate in said unpolished state to a polishing apparatus; and polishing said disk substrate with said polishing apparatus from said unpolished state to a surface finish having a roughness no greater than 6 Å, as measured by an atomic force microscope, said polishing step being accomplished without intermediate unloading of said disk substrate; and wherein said polishing step comprises a plurality of stages, including a first stage for polishing said unpolished disk substrate at a first polishing speed and a first polishing pressure, and a second stage for polishing said unpolished disk substrate as a second polishing speed and a second polishing pressure, said second stage being performed after said first stage, said second polishing speed being less than said first polishing speed and said second polishing pressure being less than said first polishing pressure.

33. The method for manufacturing a glass disk substrate of claim 32, wherein said disk drive data storage device is a rotating magnetic disk drive data storage device, said disk substrate being subsequently coated with a magnetic coating after said polishing step.

34. A method for manufacturing a glass disk substrate for a rotating disk drive data storage device, comprising the steps of:

loading a glass disk substrate to a polishing apparatus; and polishing said disk substrate with said polishing apparatus to remove at least 25 microns of material from each of two opposite flat surfaces of said disk substrate, and to a state in which said at least one flat surface has a surface roughness no greater than 12 Å, as measured by an atomic force microscope, said polishing step being accomplished without intermediate unloading of said disk substrate, from each of two opposite flat surfaces of said disk substrate during said polishing step.

35. The method for manufacturing a glass disk substrate of claim 34, wherein said polishing step polishes said disk substrate from said unpolished state to a surface finish having a roughness no greater than 6 Å, as measured by an atomic force microscope.

36. The method for manufacturing a glass disk substrate of claim 34, wherein said polishing step polishes said disk substrate from said unpolished state to a surface finish having a roughness no greater than 6 Å, as measured by an atomic force microscope.

37. The method for manufacturing a glass disk substrate of claim 34, wherein said disk drive data storage device is a rotating magnetic disk drive data storage device, said disk substrate being subsequently coated with a magnetic coating after said polishing step.

38. The method for manufacturing a glass disk substrate of claim 34, wherein said polishing step comprises a plurality of stages, including a first stage for polishing said unpolished disk substrate at a first polishing speed and a first polishing pressure, and a second stage for polishing said unpolished disk substrate as a second polishing speed and a second polishing pressure, said second stage being performed after said first stage, said second polishing speed being less than said first polishing speed and said second polishing pressure being less than said first polishing pressure.

39. The method for manufacturing a glass disk substrate of claim 34, wherein said polishing apparatus simultaneously polishes opposite flat surfaces of a plurality of said disk substrates, said polishing apparatus comprising a polishing well containing a said plurality of disk substrates, a pair of opposed polishing pads for simultaneously polishing opposite surfaces of said disk substrates, a rotating pressure plate for applying pressure to and rotating one of said polishing pads, and at least one moving carrier for carrying one or more disk substrates, said at least one moving carrier lying between said pair of opposed polishing pads.

40. A polishing apparatus for polishing glass or ceramic disk substrates for use in a rotating disk drive data storage device, comprising:

a polishing well for containing a plurality of glass or ceramic disk substrates and a polishing slurry;

a pair of opposed polishing pads for simultaneously polishing opposite surfaces of said plurality of disk substrates;

a movable pressure plate applying a programmable amount of pressure through a first of said pair of opposed polishing pads, and moving said first pad with respect to a second of said pair of opposed pads to provide polishing action;

a controller controlling the operation of said polishing apparatus, said controller being configured to polish said disk substrates in a plurality of stages, including a first stage wherein said polishing apparatus operates at a first pressure and first speed; and a second stage wherein said polishing apparatus operates as a second pressure lower than said first pressure and a second speed lower than said first speed, said first and second stages using a common polishing slurry, said second polishing stage being performed after said first polishing stage and without intermediate unloading of said disk substrate; and wherein said first polishing pressure is at least 100 g/cm2 and said second polishing pressure is approximately 30 /cm2.

* * * * *